United States Patent [19]

Noguchi

[11] Patent Number: 4,860,823

[45] Date of Patent: Aug. 29, 1989

[54] LAMINATED HEAT EXCHANGER

[75] Inventor: Ichiro Noguchi, Konan, Japan

[73] Assignee: Diesel Kiki Co., Ltd., Tokyo, Japan

[21] Appl. No.: 163,106

[22] Filed: Mar. 2, 1988

[51] Int. Cl.[4] ..... F28D 1/03; F28F 9/22

[52] U.S. Cl. ..... 165/153; 165/176; 29/157.4

[58] Field of Search ..... 165/173, 175, 153, 176; 29/157.4

[56] References Cited

U.S. PATENT DOCUMENTS

| | | | |
|---|---|---|---|
| 1,583,758 | 5/1926 | White | 165/178 |
| 1,795,055 | 3/1931 | Taylor et al. | 165/153 X |
| 1,833,314 | 11/1931 | Bruce | 165/176 X |
| 2,733,899 | 2/1956 | Lehmann | 165/176 X |
| 4,217,953 | 8/1980 | Sonoda et al. | 165/176 X |
| 4,234,040 | 11/1980 | Argyle et al. | 165/164 |
| 4,770,240 | 9/1988 | Dawson et al. | 165/176 |

FOREIGN PATENT DOCUMENTS

| | | | |
|---|---|---|---|
| 2222623 | 10/1974 | France | 165/176 |
| 527403 | 10/1972 | Switzerland | 165/153 |
| 2078361 | 1/1982 | United Kingdom | 165/176 |
| 2116687 | 9/1983 | United Kingdom | 165/153 |

*Primary Examiner*—Robert E. Garrett
*Assistant Examiner*—Carl D. Price
*Attorney, Agent, or Firm*—Wenderoth, Lind & Ponack

[57] ABSTRACT

A laminated heat exchanger includes a plurality of tube elements laminated with one another with fins interposed therebetween, and a single tank element having a refrigerant inlet and a refrigerant outlet, the tube elements and tank element being joined together via their connecting holes. The connecting holes of each tube element are provided at one end of the tube element and the connecting holes in the tank element are formed in one face of the tank element. With this construction, the single tank element can commonly be used for all of the plural tube elements.

7 Claims, 4 Drawing Sheets

LAMINATED HEAT EXCHANGER

BACKGROUND OF THE INVENTION

1. Field of the Invention

The present invention relates to a laminated heat exchanger for use in refrigerators or the like.

2. Prior art

Known laminated heat exchangers generally include a plurality of alternate layers of tube elements and fins laminated with one another. A typical example of such known laminated heat exchangers is disclosed in Japanese Patent Laid-open Publication No. 61-211694.

The disclosed heat exchanger, as reillustrated here in FIGS. 9 and 10 of the accompanying drawings, includes a plurality of tube elements 1 each of which is composed of a pair of stamped plates each having at its one end a pair of juxtaposed bowl-shaped tank-forming recessed portions 12, and an elongate channel-forming recessed portion 5 exteding from the tank-forming recessed portions 12. The two stamped plates are joined together in such a manner that the respective tank-forming recessed portions 12, 12 jointly form a pair of tanks 14, and the respective channel-forming recessed portions 5, 5 jointly form a channel 6 for the passage therethrough of a heat transferring medium. The adjacent tube elements 1, 1 are joined together with their tank-forming recessed portions 12 held in abutment with each other. The tank-forming recessed portions 12 have connecting holes 24 through which the tanks 14 of the adjacent tube elements 1 communicate with each other.

The heat tansferring medium supplied into the heat exchanger flows through the connecting holes 24 into the tanks 14 then is guided along the channels 6 in the respective tube elements 1.

The two tanks 14 are provided for each of the tube elements land hence the abutting tank-forming recessed portions 12 must have overlapping areas for joining the tanks of the adjacent tube elements 1. Since such overlapping areas extend around the connecting holes 26, they per se form blocking walls or barriers 25 which will increase the flow resistance between the tanks 14 of the adjacent tube elements 1. Particularly where the heat exchanger is used as an evaporator in a refrigerating cycle, there is a difficulty that a lubricating oil contained in a refrigerant is prevented by the barriers 25 from retruning to a compressor.

SUMMARY OF THE INVENTION

It is accordingly an object of the present invention to provide a laminated heat exchanger including a tank which is free of objectionable barriers which would otherwise prevent smooth circulation of a refrigerant and also prevent smooth return of a lubricating oil contained in the refrigerant.

Another object of the present invention is to provide a laminated heat exchanger which is compact in size.

A further object of the present invention is to provide a laminated heat exchanger having an increased degree of freedom of flow and distribution of a refrigerant to the channels.

According to the present invention, there is provided a laminated heat exchanger comprising:

a single tank element having a pair of confronting tank-forming recessed portions jointly defining therebetween a tank, and further having at least one pair of rows of first connecting holes defined in one face of said tank element;

a plurality of tube elements each having a pair of confronting channel-forming recessed portions jointly defining therebetween a channel for the passage therethrough of a heat transferring medium, each said tube element having at its one end at least one pair of second connecting holes; and said tube elements being laminated with one another with fins interposed between adjacent ones of said tube elements, said tube elements and said tank element being joined together via said first and second connecting holes.

With this construction, the tank element is structurally separated from the tube elements and has no objectionable barrier, thereby providing a minimum internal flow resistance.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Certain preferred embodiments of the present invention will be described below in detail with reference to the accompanying sheets of drawings.

Figure 1:
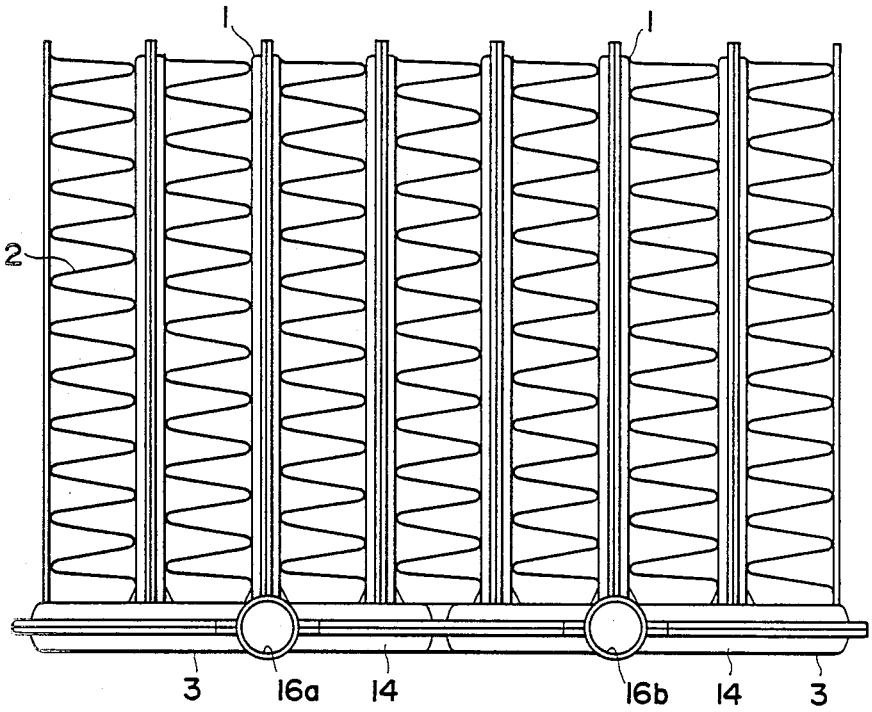
FIG. 1 is a front elevational view of a laminated heat exchanger according to the present invention.
Figure 2:
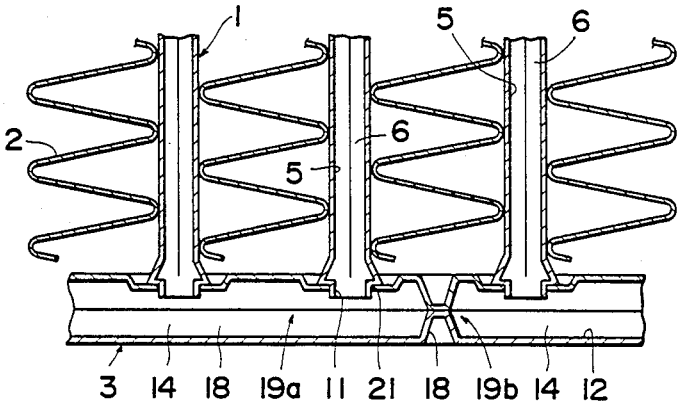
FIG. 2 is an enlarged cross-sectional view of a portion of the heat exchanger.

As shown in FIGS. 1 and 2, a laminated heat exchanger according to the present invention includes a plurality of alternate layers of tube elements 1 and corrugated fins 2 laminated with one another, and tank elements 3 connected with one end of the tube elements 1. The tube elements 1 and the fins 2 and the tube elements 1 and the tank elements 3 are joined together by brazing.

Figure 3:
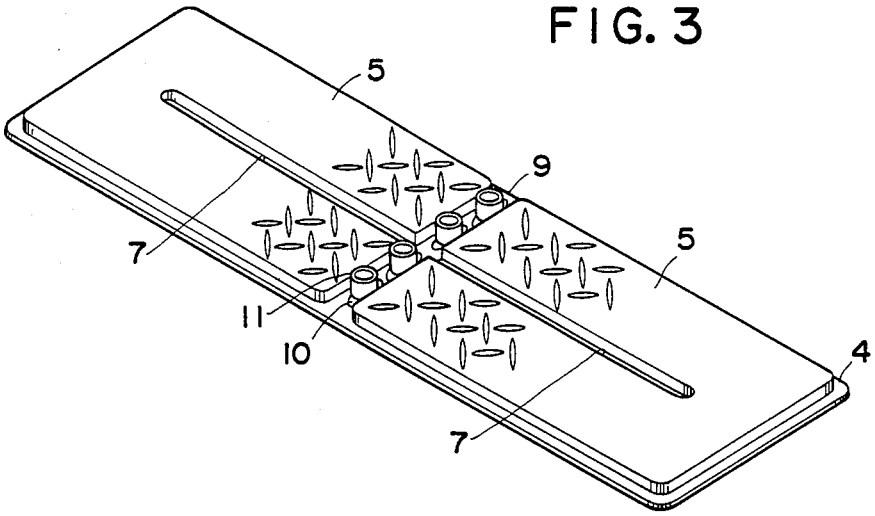
FIG. 3 is a perspective view of a stamped plate used for the formation of a tube element of the heat exchanger.
Figure 5:
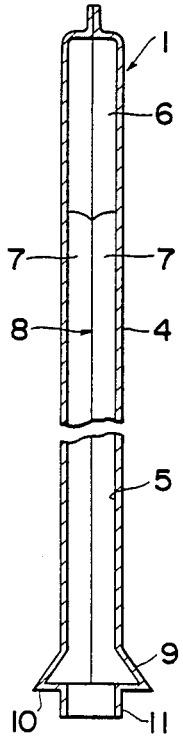
FIG. 5 is a longitudinal cross-sectional view of the tube element of FIG. 4.
Figure 4:
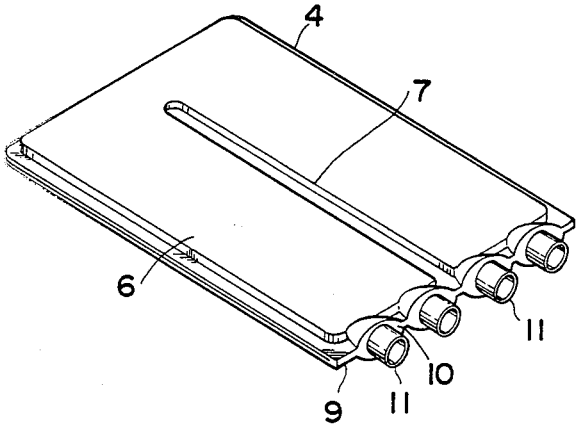
FIG. 4 is a perspective view of a tube element formed from the stamped plate shown in FIG. 3.

Each of the tube elements 1, as shown in FIG. 3, is formed from a single stamped plate 4 having a pair of channel-forming recessed portions 5, disposed in symmetrical relation to one another with respect to a bendable central transverse portion of the stamped plate 4. The stamped plate 4 is folded over itself about the bendable central transverse portion as shown in FIG. 4 so that the channel-forming recessed portions 5, are disposed in face-to-face confrontation. The recessed portions 5, are joined together along their peripheral edges so as to define therebetween a guide channel 6 for the passage therethrough of a heat transferring medium. In the guide channel 6, there are two confronting longitudinal ridges 7 projecting from the respective recessed portions 5, and held in abutment with each other so as to jointly form an elongate partition wall 8 (FIG. 5). The partition wall 8 thus formed extends longitudinally from a central section of the bendable central transverse portion 9 toward an opposite end of the tube element 1 and terminates short of the opposite end of the tube element 1. With this partition wall 8, the guide channel 6 has a general U-shape.

The tube element 1 has a flat wall 10 extending perpendicular to the general plane of the stamped plate 4 which has been folded into a U-shape. The flat wall 10 has four tubular projections each of which defines a second connecting hole 11. The hole-defining tubular projections 11 have a circular, elliptical or like cross-sectional shape and they are formed by burring from the flat wall 10 when the plate 4 is is stamped or press-formed. In the illustrated embodiment, the connecting holes are disposed two on each side of the partition wall 8 of the tube element 1.

Figure 6:
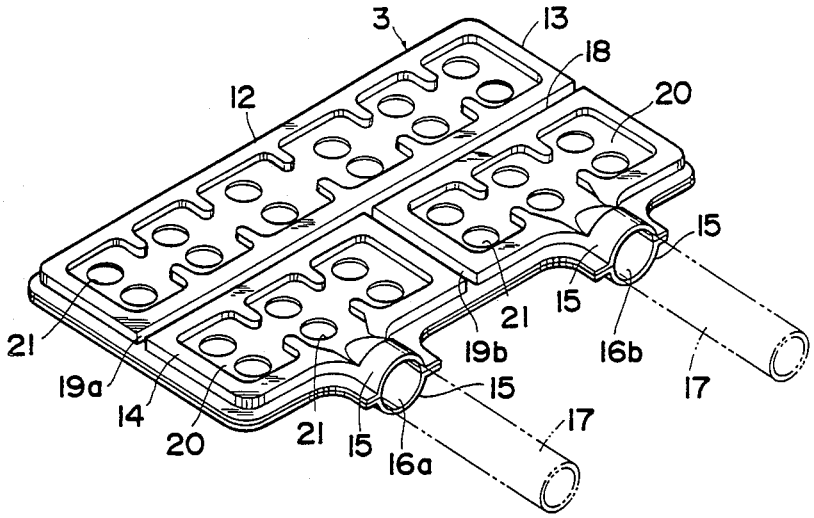
FIG. 6 is a perspective view of a tank element of the heat exchanger.

The tank element 3, as shown in FIG. 6, is composed of a pair of stamped plates 12 each having an unnumbered tank-forming recessed portion. The stamped plates 12 are joined together so that the two recessed portions 12 are disposed in face-to-face confrontation so as to jointly define therebetween a tank 14. Each of the stamped plates 13 has a pair of arcuate projections 15 extending outwardly perpendicularly from one side thereof and joined with a mating pair of arcuate projections 15 on the opposite stamped plates 13, thereby forming an inlet 16*a* and an outlet 16*b*. The inlet and outlet 16*a*, 16*b* thus formed project laterally from one side of the tank element 3 and communicate with the tank 14. In use, the inlet and outlet 16*a*, 16*b* are connected respectively with pipes 17 (shown in phantom lines) so that a heat transferring medium flows through the inlet 16*a* into the heat exchanger and after circulation through the guide channels 6 in the tube elements 1, the heat transferring medium is discharged from the heat exchanger through the outlet 16*b*.

The tank element 3 include a pair of T-shaped ridges 18 projecting from the respective recessed portions of stamped plates 12 into the tank 14 and held in abutment with each other to thereby form a T-shaped partition wall. The partition wall is composed of a longitudinal portion 19*a* separating the tank 14 into two juxtaposed elongate tank portions, and a transverse portion 19*b* disposed between the inlet 16*a* and the outlet 16*b* and extending transversely from the longitudinal portion 19*a* to subdivide one elongate tank portion into two small tank portions. The tank element 3 has on its one face a plurality of joining areas 20 corresponding in number to the number of the tube elements 1. Each of the joining areas 20 has four first connecting holes 21 receptive of the tubular projections 11 (which define the second connecting holes) of each tube element 1. The connecting holes 21 are disposed two on each side of the partition wall 19*a*.

The tubular projections defining the connecting holes 11 are inserted into the corresponding connecting holes 21 until the flat walls 10 of the respective tube elements 1 engage the joining areas 20 of the tank element 3 to thereby assemble the tube elements 1 and the tank element 3. With this assembly, the guide channels 6 in the respective tube elements 1 communicate with the tank 14 in the tank elements 3 through the connecting holes 11, 21.

With the laminated heat exchanger of the foregoing construction, the heat transferring medium supplied through the inlet 16*a* into the tank element 3 flows smoothly into one of the small portions of the tank 14, then moves upwardly along front side of the U-shaped guide channels 6 in a first group of the tube elements 1 which are disposed above the small tank portion. Upon arrival at upper ends of the partition walls 8, the heat transferring medium turns downwardly and advances through the rear side of the U-shaped guide channels 6 in the same group of the tube elements 1. Thereafter, the heat transfer,ring medium flows longitudinally across the elongate tank portion and enter into the rear side of the guide channels 6 of a second group of the tube elements 1 and then moves upwardly along the partition walls 8 until arrival at top ends of the partition walls 8. The heat transferring medium then turns from the rear side to the front side of the guide channels 6 of the same tube elements 1 and flows downwardly toward the other small tank portion from which it is finally discharged through the outlet 16*b* to the outside of the heat exchanger.

In the illustrated embodiment, the tube elements 1 are connected with the tank element 3 by inserting the tubular projections 11 on the flat wall 10 of the tube elements 1 into the connecting holes 21 in the joining areas 20 of the tube element 3. Conversely, the tank element 3 may have tubular projections defining connecting holes in which instance the tube elements 3 have connecting holes receptive of the tubular projections.

As an alternative, the tube element 1 may be composed of a pair of superposed stamped plates joined in a conventional manner, instead of folding a single stamped plate.

Figure 7:
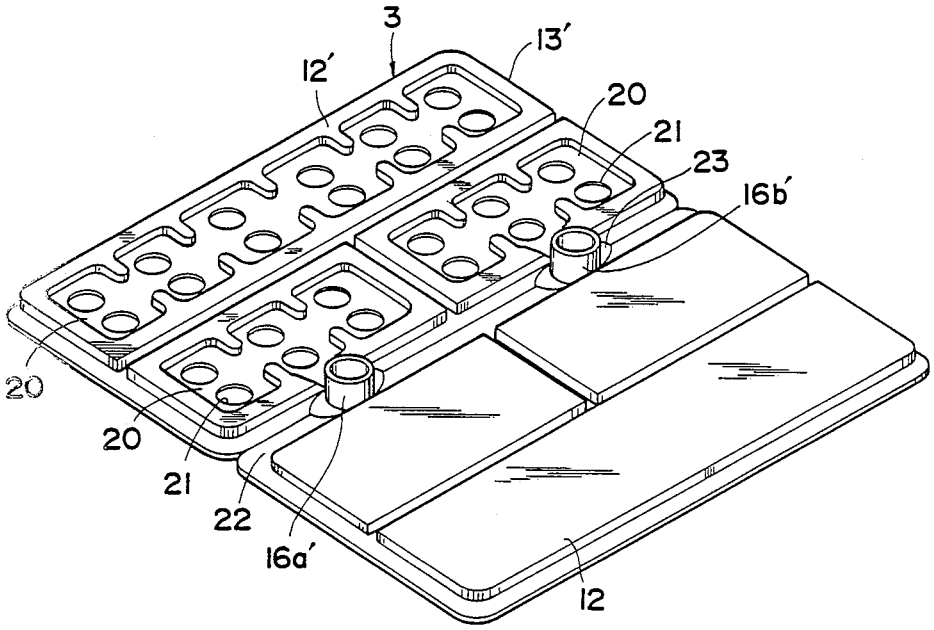
FIG. 7 is a perspective view of a stamped plate used for the formation of a modified tank element.
Figure 8:
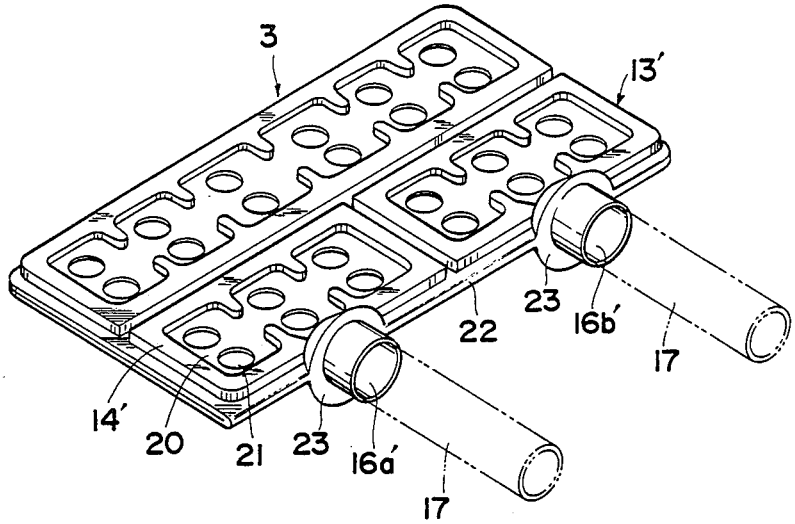
FIG. 8 is a perspective view of a tank element formed from the stamped plate shown in FIG. 7.
Figure 9:
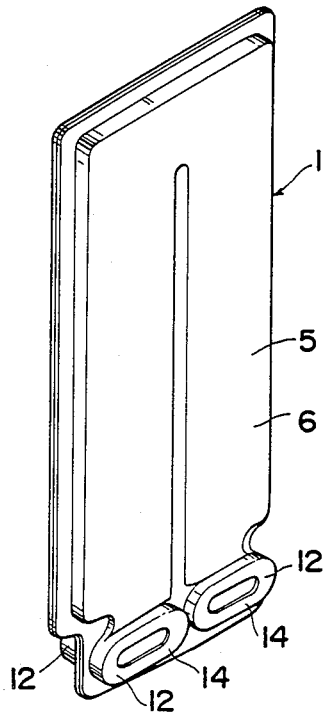
FIG. 9 PRIOR ART
FIG. 9 is a perspective view of a conventional tube element.
Figure 10:
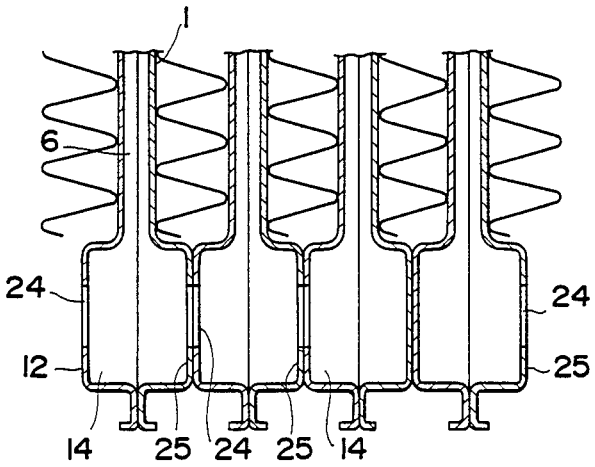
FIG. 10 PRIOR ART
FIG. 10 is an enlarged cross-sectional view of a portion of a laminated heat exchanger having a plurality of the conventional tube elements.

The tank element 3 may be formed from a single stamped plate 13', as shown in FIG. 7. In this instance, the stamped plate 13' has a pair of tank-forming recessed portions 12' disposed in symmetry with each other with respect to a bendable central transverse portion. Likewise the stamped plate 4 of the tube element 1, the stamped plate 13' is folded over itself about the bendable central transverse portion in such a manner that the two tank-forming recessed portions 12' are disposed in face-to-face confrontation. The recessed portions 12' are joined together along their peripheral portions, thereby defining therebetween a tank 14'. The bendable central transverse portion 22 has a flat wall 23 and two tubular projections disposed on the flat wall 23 and defining respectively therein an inlet 16*a'* and an outlet 16*b'*.

Obviously, many modifications and variations of the present invention are possible in the light of the above teaching. It is therefore to be understood that within the scope of the appended claims, the invention may be practiced otherwise than as specifically described.

What is claimed is:

1. A laminated heat exchanger comprising:

a single tank element, said single tank element including a single stamped plate having a bendable central portion and a pair of tank-forming recessed portions on opposite sides of said bendable central portion, said stamped plate being folded over itself about said bendable central portion, said bendable central portion having an inlet and an outlet, said pair of confronting tank-forming recessed portions jointly defining therebetween a tank, and said single tank element having at least one pair of rows of first connecting holes defined in one face thereof;

a plurality of tube elements each having a pair of confronting channel-forming recessed portions jointly defining therebetween a tube-element channel for passage therethrough of a heat transferring medium, each one of said plurality of tube elements having first and second ends, each said first end having at least one pair of second connecting holes, said plurality of tube elements being laminated with one another, and said plurality of tube elements and said single tank element being joined together via said first and second connecting holes; and a plurality of fins interposed between adjacent ones of said plurality of tube elements.

2. A laminated heat exchanger as in claim 1, wherein said first connecting holes in said single tank element are connected with corresponding ones of said second connecting holes in said plurality of tube elements through a male-and-female fitting.

3. A laminated heat exchanger as in claim 1, wherein said single tank element includes a pair of first and second T-shaped ridges projecting from a respective one of said pair of tank-forming recessed portions into said tank, and said first T-shaped ridge abuts said second T-shaped ridge for jointly defining a T-shaped partition wall disposed in said tank and separating said tank into three tank portions.

4. A laminated heat exchanger as in claim 1, wherein each one of said plurality of tube elements has a pair of first and second tube-element ridges projecting from a respective one of said pair of confronting channel-forming recessed portions into said channel, said first tube-element ridge abuts said second tube-element ridge for jointly defining a tube-element partition wall, said first and second tube-element ridges extend from one of said first and second ends of said tube element to an opposite one of said first and second ends of said tube element, and said first and second ridges terminate short of said opposite end of said tube element for causing said tube-element channel to be substantially U-shaped.

5. A laminated heat exchanger comprising:

a single tank element, said single tank element including a pair of confronting tank-forming recessed portions, said pair of confronting tank-forming recessed portions jointly defining therebetween a tank, said single tank element having at least one pair of rows of first connecting holes defined in one face thereof, and a pair of first and second T-shaped ridges projecting from a respective one of said pair of tank-forming recessed portions into said tank, said first T-shaped ridge abutting said second T-shaped ridge for jointly defining a T-shaped partition wall disposed in said tank and separating said tank into first, second, and third portions;

a plurality of tube elements each having a pair of confronting channel-forming recessed portions jointly defining therebetween a tube-element channel for passage therethrough of a heat transferring medium, each one of said plurality of tube elements having first and second ends, each said first end having at least one pair of second connecting holes, said plurality of tube elements being laminated with one another, said plurality of tube elements and said single tank element being joined together via said first and second connecting holes, and said T-shaped partition wall causing a heat transferring medium flowed into said first tank portion to flow through said first tank portion into said second tank portion via at least one of said tube elements and from said second tank portion into said third tank portion via at least one other of said tube elements; and a plurality of fins interposed between adjacent ones of said plurality of tube elements.

6. A laminated heat exchanger as in claim 5, wherein said single tank element includes a pair of first and second stamped plates, said first stamped plate is disposed above said second stamped plate, and each said first and second stamped plates has one of said pair of tank-forming recessed portions.

7. A laminated heat exchanger comprising:

a single tank element, said single tank element including a pair of confronting tank-forming recessed portions, said pair of confronting tank-forming recessed portions jointly defining therebetween a tank, said single tank element having at least one pair of rows of first connecting holes defined in one face thereof, and a pair of first and second T-shaped ridges projecting from a respective one of said pair of tank-forming recessed portions into said tank, said first T-shaped ridge abutting said second T-shaped ridge for jointly defining a T-shaped partition wall disposed in said tank and separating said tank into first, second, and third portions;

a plurality of tube elements, each said tube element including a single stamped plate having a bendable central portion and a pair of confronting channel-forming recessed portions, said pair of confronting channel-forming recessed portions jointly defining therebetween a tube-element channel for passage therethrough of a heat transferring medium, each one of said plurality of tube elements having first and second ends, each said first end having at least one pair of second connecting holes, said plurality of tube elements being laminated with one another, said plurality of tube elements and said single tank element being joined together via said first and second connecting holes, and said T-shaped partition wall causing a heat transferring medium flowed into said first tank portion to flow through said first tank portion into said second tank portion via at least one of said tube elements and from said second tank portion into said third tank portion via at least one other of said tube elements; and a plurality of fins interposed between adjacent ones of said plurality of tube elements.

* * * * *